US005790148A

United States Patent [19]

Gavillet et al.

[11] Patent Number: 5,790,148

[45] Date of Patent: Aug. 4, 1998

[54] INSERTABLE PRINTER HEAD CAP FOR AN INK JET PRINTER

[75] Inventors: Gilbert Gavillet, Donneloye; Marcellino Requena, Yverdon, both of Switzerland

[73] Assignee: OCD SA, Yverdon, Switzerland

[21] Appl. No.: 562,217

[22] Filed: Nov. 28, 1995

[30] Foreign Application Priority Data

Dec. 30, 1994 [CH] Switzerland ..... 3970/94

[51] Int. Cl.[6] ..... B41J 2/165

[52] U.S. Cl. ..... 347/29; 347/32; 347/22

[58] Field of Search ..... 347/29, 30, 31, 347/22, 24; 220/789, 795, 221, 526, 655; 342/29, 30, 31, 24, 22

[56] References Cited

U.S. PATENT DOCUMENTS 5,153,613 10/1992 Yamaguchi et al. ..... 347/32

5,155,497 10/1992 Martin et al. ..... 347/29

FOREIGN PATENT DOCUMENTS 0 653 306 5/1995 European Pat. Off. .

0 674 996 10/1995 European Pat. Off. .

*Primary Examiner*—N. Le

*Assistant Examiner*—Thien Tran

*Attorney, Agent, or Firm*—Young & Thompson

[57] ABSTRACT

The printer has a standby station (3) including a main movable support (4) on which is mounted slidably and resiliently by virtue of a spring (14), a main cap (5) integral with a cap carrier (6). An exchangeable printer head (8) plugged onto a traveller is moved towards the standby station facing the main cap (5) which is subsequently applied against the nozzles of the printer head. At least one second printer head (10) of another type can be plugged onto the traveller. A selection member (11) provided on the second head (10) controls the positioning of a secondary cap (12) inserted between the main cap (5) and the second printer head (10). This secondary cap (12) is then applied by the action of the main movable support (4) against the second printer head to prevent the drying of the ink. The soiling of the printer head by the ink of another printer head can. thus be avoided by virtue of a standby station of a very simple construction which can be adapted to existing printers.

9 Claims, 4 Drawing Sheets

INSERTABLE PRINTER HEAD CAP FOR AN INK JET PRINTER

FIELD OF THE INVENTION

The present invention is concerned with an ink jet printer provided with a moving traveller arranged in such a manner that it can receive a printer head which can be exchanged for at least another printer head of a second type, the printer including a standby station having at least two types of caps designed for being applied on the printer head to which they are intended.

BACKGROUND OF THE INVENTION

In ink jet printers, it is a common practice to protect the ink projecting nozzles of the printer head, when the head is in its non-operative position for extended periods of time between printing operations, in order to prevent the drying of the ink, which would lead to the blocking up of the nozzles.

To this end, a cap is applied against the nozzle plate, which maintains a certain degree of moisture. The object of the present invention is applicable to a printer provided with an exchangeable printer head which can be plugged onto the movable traveller of the printer.

Different types of heads can be plugged onto the traveller, for example a head filled with black ink or a head filled with a colored ink.

To avoid a cross-contamination through the cap, of the ink of one printer head by that of the other, for example of a colored ink by black ink, a specific cap is provided for each type of plugged head.

The U.S. Pat. No. 5 155 497 describes a standby station for a printer of this type. This station includes a support rotating by 180° around an axis parallel to the direction of motion of the traveller and on which are mounted in opposite positions two caps through slides movable longitudinally along this direction of motion of the movable traveller. After the detection of the type of printer head mounted on the traveller, the rotating support positions by rotation the slide and the cap corresponding to the head, and the traveller then pulls the slide longitudinally to apply the cap against the nozzle plate.

This standby station includes a large number of parts and is of a complicated construction. Furthermore, it cannot be integrated into already existing printers.

SUMMARY OF THE INVENTION

The purpose of the present invention is remedy these drawbacks and the invention is characterized to this end by the fact that the standby station includes at least one main cap mounted on a main movable support and designed for cooperating with an exchangeable printer head and at least one additional cap which is mounted on at least one secondary movable support and which is arranged in such a manner as to be inserted between the main cap and the printer head of the second type.

By such measures, one obtains a construction which is very compact and very simple, and easily adapted to existing printers originally designed for a single type of printer head.

According to an advantageous embodiment, the printer head of the second type exhibits at least one member of a shape different from that of the exchangeable printer head, this member being arranged in such a manner as to control the displacement of the secondary movable support, to insert the additional cap or caps between the main cap and the printer head of the second type when the traveller carrying the printer head of the second type is moved towards the standby station.

The shape of the printer head thus determines the selection of the cap which will be applied against the nozzles, which ensures that the functioning is simple and reliable and provides a construction cheap to manufacture.

Advantageously, the secondary movable support or supports are mounted on the printer to slide along a direction parallel to the direction of motion of the movable traveller, the printer including a lever mechanism actuated by said differently shaped member and arranged in such a manner as to move the movable secondary support or supports against the action of a resilient member for inserting at least one additional cap between the main cap and the printer head of the second type, when the traveller is moved towards the standby station.

These characteristics contribute to simplifying the construction of the standby station and make possible an easy adaptation of existing stations to several printer heads and to the same number of caps.

Advantageously, the application of the additional cap or caps against the printer head of the second type plugged onto the traveller is effected by the pushing of the main cap in the direction of this printer head.

These characteristics ensure a functioning which is reliable and provide for a construction which is compact, with a reduced number of components.

Other advantages will become apparent from the characteristics set forth in the dependant claims and from the more detailed description hereafter of the invention, making use of the accompanying drawings which represent schematically an exemplary embodiment of the invention.

DESCRIPTION OF THE PREFERRED EMBODIMENTS

Figure 1A:
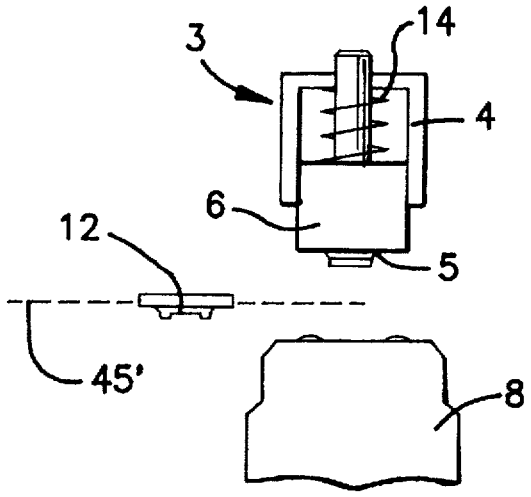
FIGS. 1*a*) to 1*d*) illustrate schematically the principles on which the invention is based.
Figure 1B:
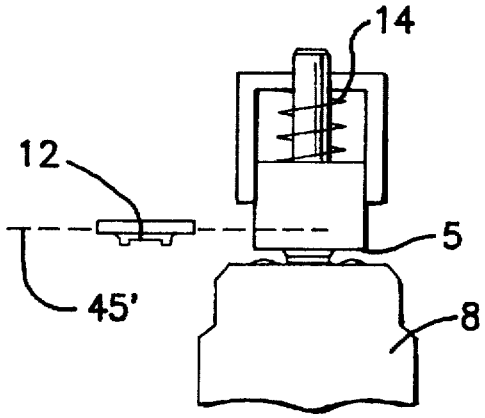

With reference to FIG. 1*a*, the standby station 3 of a printer includes a main movable support 4 on which is mounted slidably a main cap 5 integral with a cap carrier 6. An exchangeable printer head 8 plugged onto a traveller is moved to a position in the standby station where it faces the main cap 5. The latter is then applied against the nozzles of the front part of the printer head 8, to avoid the drying up of the ink, as shown in FIG. 1*b*).

Figure 1C:
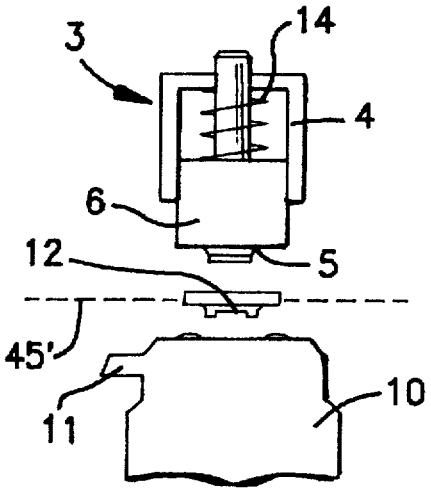
Figure 1D:
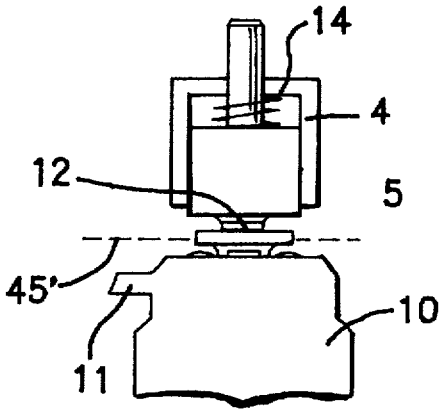

The printer is arranged to receive at least one printer head 10 of another type having a part or a member 11 of a different shape (FIG. 1*c*). This member 11 acts as the selection member for controlling the positioning of an additional cap 12 which is inserted between the main cap 5 and the front part of the printer head 10, when the latter is mounted on the traveller. The additional cap 12 is affixed to a support mounted pivotally and slidably on a shaft having an axis 45 '. Thereafter, the application of the additional cap 12 against the printer head 10 is effected by the pressure of the main cap 5 in the direction of the printer head 10. When the exchangeable printer head 8 is mounted on the traveller, the additional cap 12 remains stationary in a position offset sidewise as can be seen in FIGS. 1*a* and 1*b*.

The main cap 5 with its cap carrier 6 are mounted resiliently in the support 4, in which they can slide over a predetermined range, limited by stops (not represented), by virtue of a spring 14 which is more or less compressed depending on whether the additional cap 12 is inserted or not.

The construction of this embodiment is explained in more detail with reference to FIGS. 2 and 5. Thus, in FIGS. 2 and 3, the traveller 20 carrying the exchangeable printer head 8 slides on a shaft 21 and reciprocates along the document for its printing.

The standby station 3 is provided laterally outside of the printing zone in such a manner as to cooperate with the traveller 20 and the printer head 8 or 10 plugged onto this traveller. This standby station 3 includes a frame 24 on which is mounted to slide vertically the main movable support 4 pulled by a spring 25 against a stop 26 (FIG. 2). The main movable support 4 carries the cap carrier 6 and the main cap 5 which can be lowered, as illustrated in phantom in FIG. 3, to be applied directly against the exchangeable printer head 8. To this end, the printer includes an actuator mechanism 30 including a lever 31 rotatable about a pivot 32 on the frame 24. This lever 31 has a branch 33 designed for cooperating with a part 34 of the traveller 20 and a branch 36 designed for cooperating with the main movable support 4.

Figure 2:
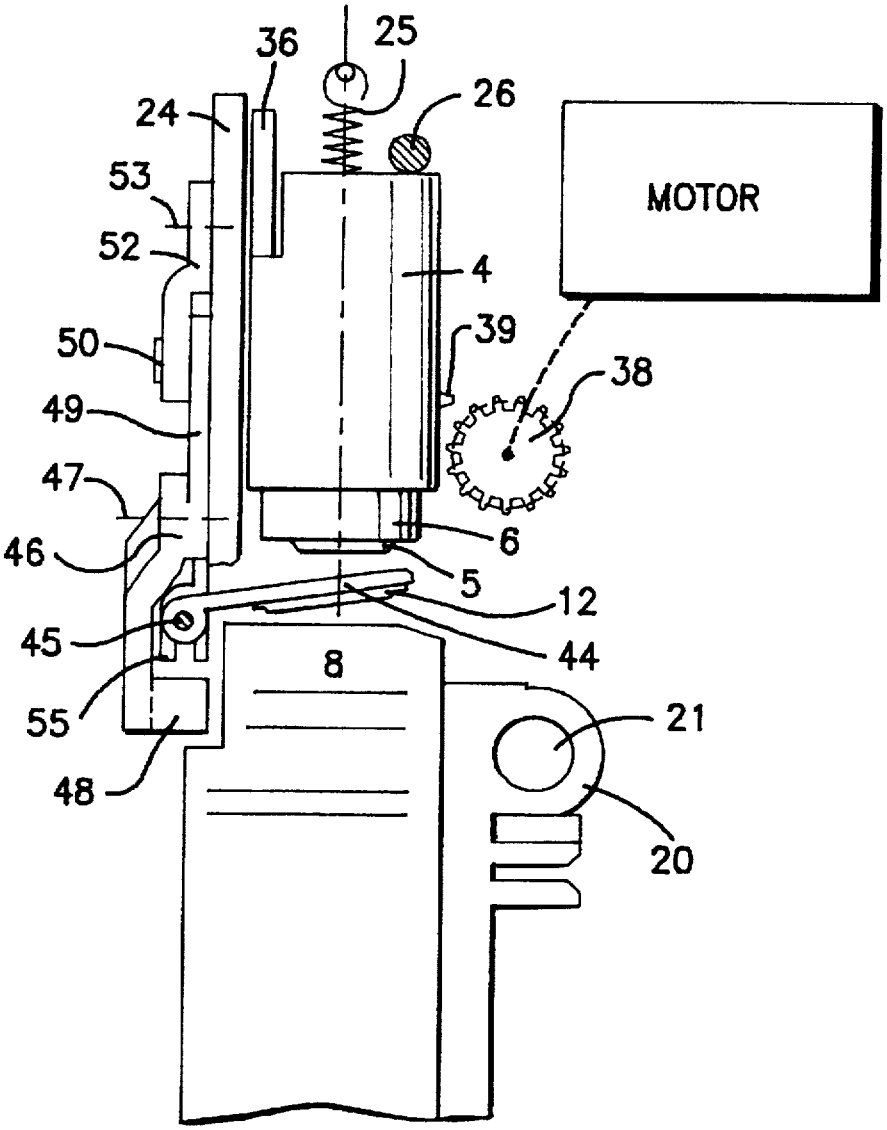
FIG. 2 is a side view of the embodiment represented during printing.
Figure 3:
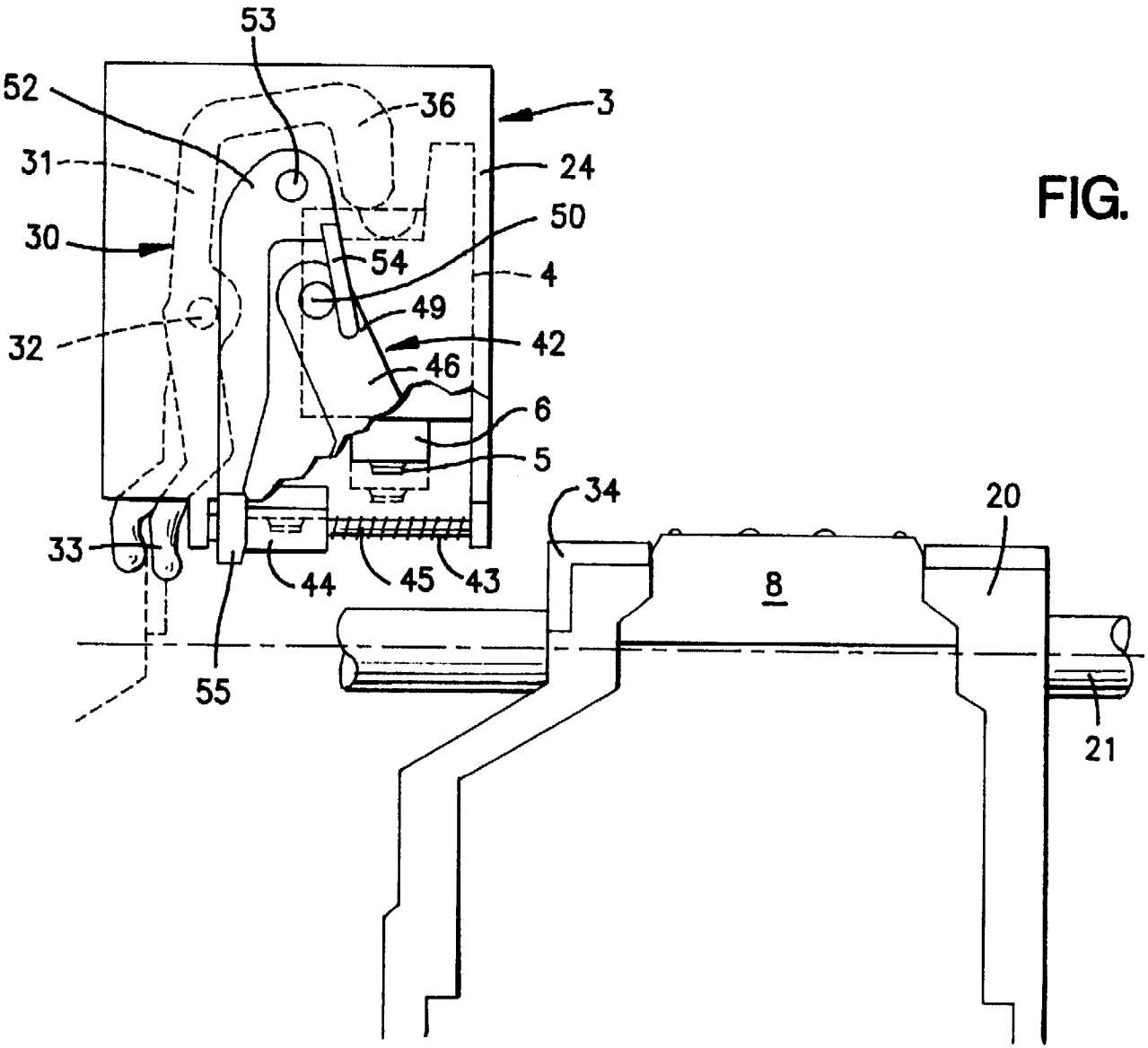
FIG. 3 is a front view of FIG. 2, with some of the components not illustrated.

The actuator mechanism 30 is further provided with a gear wheel 38 driven in rotation by a motor (not illustrated) of the printer and which is capable of cooperating with a tooth 39 integral with the main movable support (FIG. 2).

When the traveller 20 comes into the non operative position in the standby station 3, its part 34 exerts a pressure against the branch 33 of the lever 31. The latter, by pivoting on the frame 24 biases through its branch 36 the main movable support 4 downwards, so as to move the same by the distance necessary for engaging the tooth 39 with the teeth of the gear wheel 38, as shown in phantom in FIG. 3.

When the traveller is stopped in the standby station, the motor of the printer drives in rotation the gear wheel 38 to apply resiliently the main cap 5 against the face of the nozzles of the printer head 8.

Figure 5:
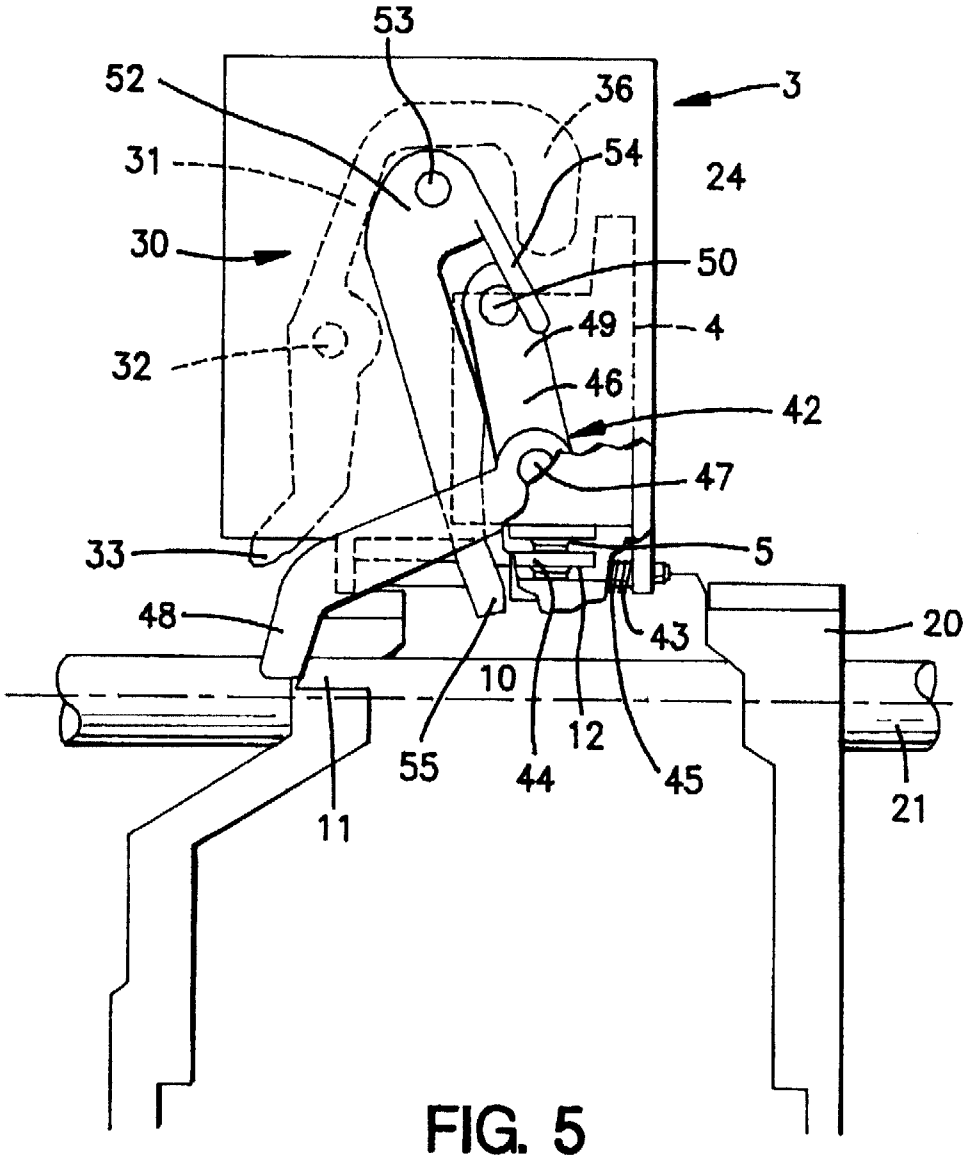
FIG. 5 is a front view of FIG. 4, with some of the components not represented.
Figure 4:
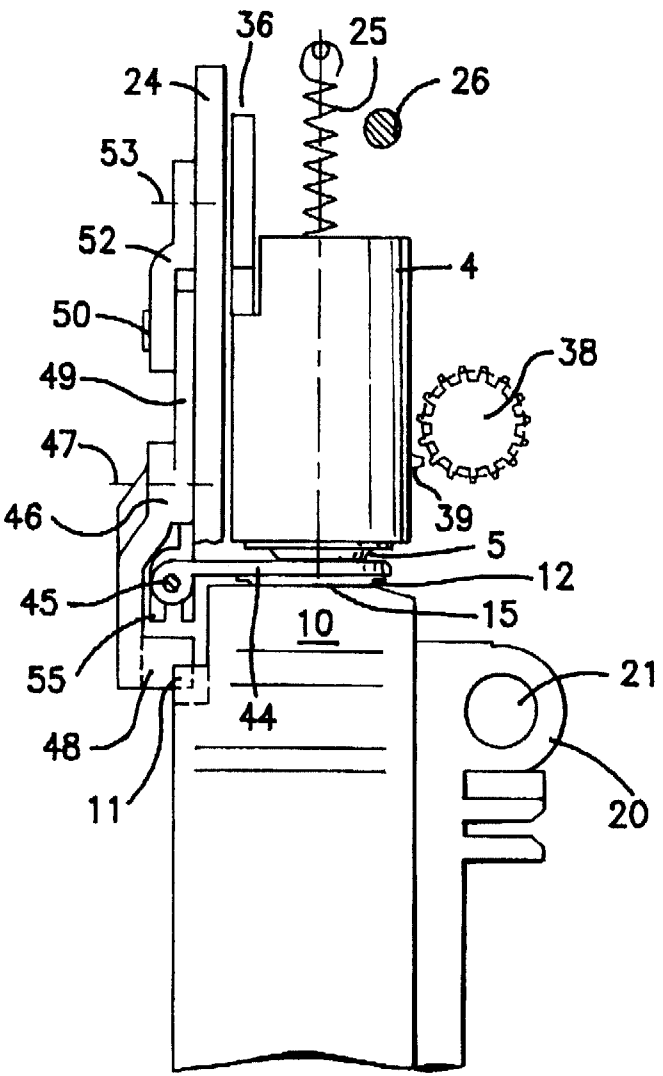
FIG. 4 is a side view of an embodiment shown with the printer head in the non operative position in the standby station.

With reference to FIGS. 4 and 5, the printer head 10 of a second type can be plugged onto the traveller 20 in replacement of the head 8. The member 11 of a different shape is provided as a finger 11 designed for cooperating with the lever mechanism 42 for inserting the additional cap 12 between the main cap 5 and the printer head 10.

This additional cap 12 is affixed to a secondary movable support 44 mounted pivotally and slidably on a shaft 45 fastened on the frame 24. A spring 43 placed over this shaft biases the secondary movable support 44 towards a non operative position illustrated in FIGS. 2 and 3, in which the secondary cap 12 is pivoted by an angle of about 20° upwards with respect to the horizontal line, about the left-hand shaft 45.

The lever mechanism 42 includes a first lever 46 mounted pivotally at 47 on the frame 24. It exhibits a first branch 48 capable of cooperating with the finger 11 acting as a shaped member and a second branch 49 including a stop 50 cooperating with a second lever 52 of the mechanism. This lever 52 is mounted pivotally at 53 on the frame 24 and comes in contact with the stop through a branch 54 and with the secondary movable support 44 through a branch 55.

Accordingly, the printer head 10 of the second type thus acts on the couple of levers 46, 52 which transmits the translational motion of the head to the secondary movable support 44 to place the additional cap 12 facing this printer head 10. The distance separating the main cap 5 from the surface of the nozzles 15 of the printer head 10 is sufficient for allowing the free insertion of the secondary movable support assembly 44 and the secondary cap 12.

Then, the downward sliding motion of the main movable support 4 is carried out as described above. The main movable support 4 then biases the secondary movable support 44 against the printer head 10, the secondary cap 12 applying itself against the surface of the nozzles 15. Following an order to print, the motor of the printer causes the pivoting of the gear wheel 38 in the clockwise direction in FIG. 4 to bring the tooth 39 upwards. The traveller 20 can then leave the standby station, and the main and the secondary movable supports are moved by the action of the springs 25 and 43 to the non operative position shown in FIGS. 2 and 3.

Clearly, the embodiment described above is not of a limiting nature and can receive any desirable modifications within the framework such as defined in claim 1. In particular, the mechanisms controlling the insertion of the secondary cap and the lowering of the movable supports could be achieved differently, for example without the intervention of levers, by the direct action of a part of the printer head and of the traveller on the secondary and on the main movable supports. One could obviously apply the same principle to another version accommodating three printer heads or more. In this case, the secondary movable support would include two or more caps of which the positioning opposite the plugged printer head would be ensured by fingers of differing lengths on the respective printer heads; the sliding range of the secondary movable support would be controlled, for example, by fingers provided on the printer heads.

One or several caps could be connected by a flexible tube to a suction pump which would ensure the priming of the printer head or they can be provided with a cushion for absorbing the ink. The standby station could also be equipped with one or several pads for wiping the front part of the printer heads. These pads can be mounted retractably or not on the main movable support or on the frame.

What is claimed is:

1. An ink jet printer having a printer head of a first type and an exchangeable printer head of a second type, the printer comprising:

a cap of a first type for capping the printer head of the first type; and a cap of a second type for capping the printer head of the second type and a means for insertion said cap of said second type and a printer head of the second type, the cap of the second type having a first surface mateable with said cap of the first type, and a second surface mateable with the printer head of the second type.

2. A printer head cap for an ink jet printer having a printer head of a first type and an exchangeable printer head of a second type, the cap comprising:

a body having a first surface, and a second surface;

said first surface mateable with a cover for capping the printer head of the first type; and said second surface mateable with the printer head of the second type, and a means for insertion said body between the cover and the printer head of the second type thereby capping the printer head of the second type.

3. A printer according to claim 1, further comprising:

a standby station, located laterally outside of a printing zone of said printer;

a movable traveller onto which are plugged one of said first printer head and second type printer head for transporting said one of said printer heads to the printing zone;

means for moving said traveller; and a secondary movable support in said standby station and upon which is mounted the cap of the second type, wherein the printer head of the second type has at least one differently shaped member that is not found on the printer head of the first type, the differently shaped member for controlling movement of the secondary movable support for inserting the cap of the second type between said cap of the first type and the printer head of the second type, when the traveller provided with the printer head of the second type is moved toward the standby station.

4. A printer according to claim 1, wherein the cap of the second type has a generally flat shape.

5. A printer according to claim 3, further comprising:

means for slidably mounting the secondary movable support on the printer parallel to a direction of motion of the movable traveller, a lever mechanism actuated by said at least one differently shaped member to move said secondary movable support against a resilient member for inserting the cap of the second type between the cap of the first type and the printer head of the second type, when the traveller is moved toward the standby station.

6. A printer according to claim 3, further comprising means for applying the cap of the second type against the printer head of the second type plugged onto the traveller, by pressure applied by the cap of the first type toward the printer head of the second type.

7. A printer according to claim 6, further comprising:

a main movable support upon which is mounted the cap of the first type; and an actuator mechanism for moving the main movable support in a direction of said one of the printer heads plugged onto the traveller, the actuator mechanism having a gear wheel for being driven in rotation by a motor of the printer and for cooperating with a protruding member integral with the main movable support, the actuator mechanism including a control member for cooperating with the movable traveller when the traveller is moved toward the standby station, for moving the main movable support from a first position in which the protruding member is not in contact with the gear wheel towards a second position in which the protruding member is engaged with the gear wheel, so that the gear wheel drives the main movable support in the direction of said one of the printer heads plugged onto the traveller.

8. A printer according to claim 7, wherein the cap of the first type is axially resilient with respect to the main movable support.

9. A printer according to claim 8, further comprising means for mounting the cap of the first type through a spring on the main movable support.

* * * * *